United States Patent [19]

LeVert

[11] 4,218,043

[45] Aug. 19, 1980

[54] MANUAL AUTOMOBILE PUSHER

[76] Inventor: Francis E. LeVert, 1909 Matthew La., Knoxville, Tenn. 37919

[21] Appl. No.: 11,174

[22] Filed: Feb. 9, 1979

[51] Int. Cl.[3] ..... B66F 1/04

[52] U.S. Cl. ..... 254/35; 254/108; 254/134; 254/DIG. 1; 254/DIG. 4

[58] Field of Search ..... 254/1, 35, 95–97, 254/108–111, 120, 124, 126, 129–130, 131, 133, 134, DIG. 1, DIG. 4

[56] References Cited

U.S. PATENT DOCUMENTS

| | | | |
|---|---|---|---|
| 486,528 | 11/1892 | Bryant et al. | 254/133 |
| 1,325,964 | 12/1919 | Templeton | 254/111 |
| 1,821,627 | 9/1931 | Fotheringham | 254/126 |
| 2,144,303 | 1/1939 | Wiedman | 254/DIG. 1 |
| 3,029,065 | 4/1962 | Buddingh | 254/35 |
| 3,099,435 | 7/1963 | Nixon | 254/35 |
| 4,025,053 | 5/1977 | Stickle | 254/133 R |

*Primary Examiner*—Robert C. Watson

[57] ABSTRACT

A manual automobile pusher comprises a long handle ratchet mechanism mounted on one end of a curved hollow rectangular shaped sleeve, a padded cradle connected to the opposite end of the rectangular shaped sleeve, a curved rack post along which the ratchet mechanism and hollow rectangular shaped sleeve moves, a broad base which is connected to the curved rack post by a pivot pin, and an extensible cross member that is firmly connected to the broad base and the hollow rectangular shaped sleeve. The manual car pusher is capable of developing sufficient horizontal and vertical forces to slowly push an automobile out of a rut in ice, snow or mud, thereby eliminating the waste of gasoline and automobile transmission wear that occurs when a lone driver attempts to free an immobile vehicle by driving it out of a rut.

1 Claim, 1 Drawing Figure

MANUAL AUTOMOBILE PUSHER

BACKGROUND OF THE INVENTION

This invention relates to the extrication of immobile automobiles when one or more tires are trapped in ruts in ice, snow or mud such that driving wheels traction is not enough to develop motion of the vehicle.

There are several well-known means for removing an automobile from ruts in mud, snow or ice. These involve the use of rock salt, abrasive such as sand or gravel, rocking motion brought about by rapid changes in the gears of the automobile from forward to reverse, manual pushing, and tow trucks equipped with mechanical winches. Of these methods, the most successful involves the use of tow trucks equipped with mechanical winches. But during periods of severe weather conditions it is difficult to secure the service of a tow truck with winching capabilities. Thus, most often, motorists resort to one of the first four methods. The rocking motion method is the most frequently used technique. Unfortunately, it is also the one method which results in the waste of gasoline and wear and tear on the tires and transmission of the vehicle. Manual pushing, which requires more than one person, is frequently successful but it involves the risk of bodily injury and also a considerable waste of gasoline as the driver attempts to aid the human pushers.

It would be useful to have a device that an average individual could use to extricate an immobile vehicle from an ice, snow or mud rut and that would be small and lightweight enough to be inserted in the trunk of an automobile. It is an object of the present invention to provide a method and means of extricating a vehicle from a rut. It is a further object of the present invention to make a lightweight and portable automobile pusher.

Other objects of this invention will become obvious in the course of the detailed description.

DETAILED DESCRIPTION OF THE INVENTION

Figure 1:
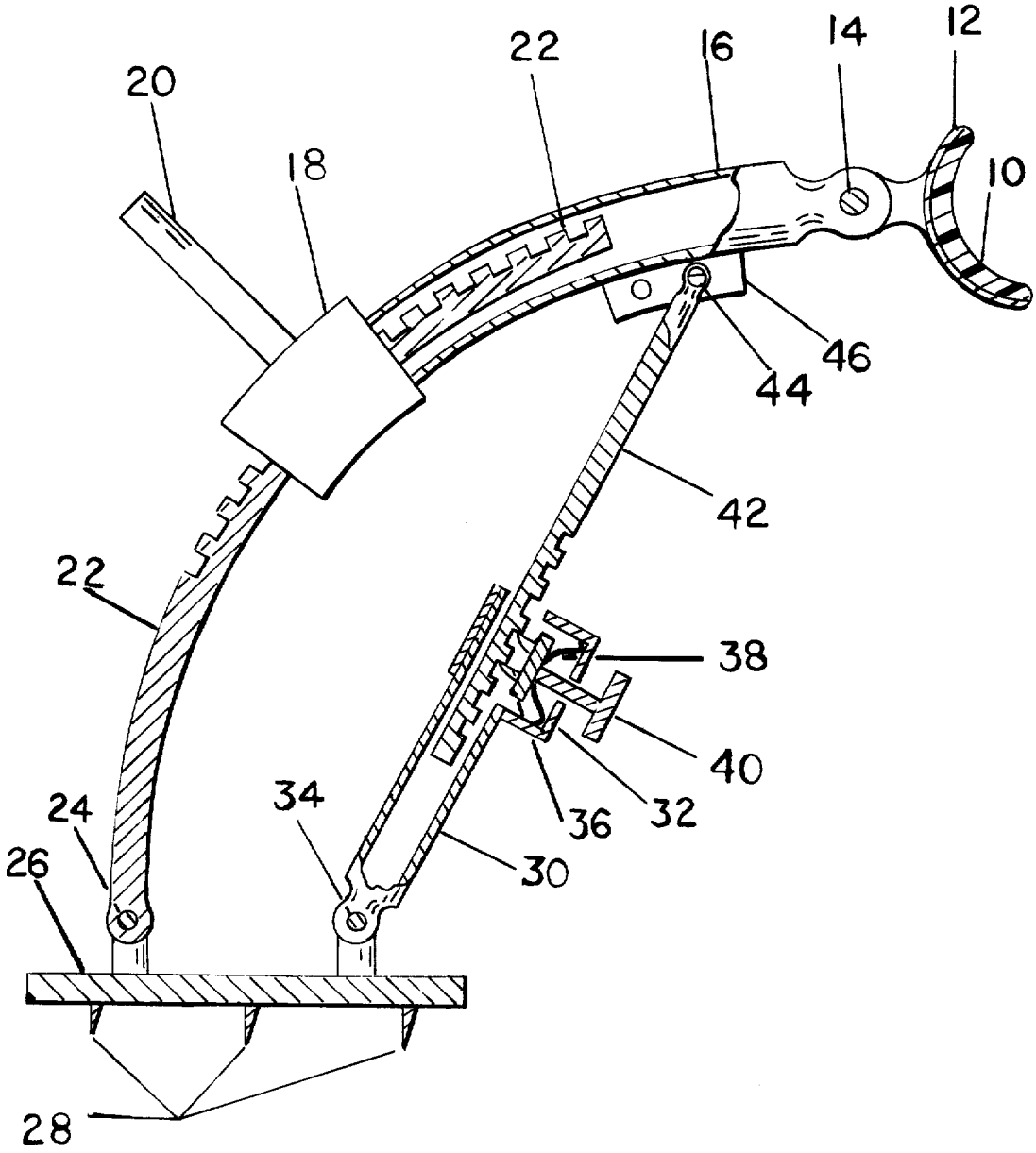

FIG. 1 is a sectional side view of the invention.

In FIG. 1, rubber cradle 10 is mounted as by adjesive to curved high strength aluminum cradle 12. The rubber cradle and the high strength aluminum cradle 10 and 12, respectively, are designed to make a firm high friction contact with either the front or rear bumper of an average automobile. Said aluminum cradle 12 is connected as by steel pivot 14 to curved hollow rectangular metal sleeve 16. The contact surfaces between said aluminum cradle 12 and the hollow rectangular metal sleeve 16 are designed with matching teeth so as to make the angle between the two adjustable. Said hollow rectangular metal sleeve 16 is designed with a 145.54 centimeter radius of curvature, a 2.54 centimeter width, a 3.84 centimeter height and a wall thickness of 0.80 centimeters. The arc length of said hollow rectangular metal sleeve 16 is 46 centimeters. Ratchet mechanism 18 is rigidly connected to said hollow rectangular metal sleeve 16 such that the ratchet and said hollow rectangular metal sleeve 16 form a continuous rectangular sleeve. Said ratchet mechanism 18 consists of an ordinary automobile jack mechanism. Said ratchet mechanism 18 is operated by metal bar 20 and moves along rack post 22. The rack post 22 is constructed of iron and is rectangular in shape with a radius of curvature equal to that of said hollow rectangular metal sleeve 16. Said rack post 22 is connected as by smooth steel pin 24 to metal rectangular base 26. Metal studs 28 are mounted on the obverse side of the metal rectangular base 26 and are designed to prevent slippage on a surface that may be 100% ice. Hollow metal cylinder 30 on which is mounted spring loaded mechanism 32 is connected as by smooth pivot pin 34 to the metal rectangular base 26. The spring loaded mechanism 32 is composed of iron stopper 36 which is mounted against steel spring 38, and engage/disengage lever 40. When said spring loaded mechanism 32 is engaged as by the lever 38, the iron stopper 36 makes firm contact with rack post 42 allowing movement of the rack post 42 in one direction. Said rack post 42 is connected by smooth pivot pin 44 to metal anchor 46 which is rigidly connected to said hollow rectangular metal sleeve 16. The anchor 46 is designed such that the device may be adjusted for different bumper heights above a surface. Said rack post 22 and said hollow rectangular metal sleeve 16 are of rectangular cross sections; however, they could equally as well be triangular, square or round in cross sectional shape. Said metal rectangular base 26, also, could equally as well be a triangular or curved metal plate with edges designed to prevent slippage under load. While the present invention makes use of said ratchet mechanism 18 to perform the mechanical work, the mechanical work could equally as well be performed by a worm gear - rack post combination such as commonly used in automobile jacks.

To operate the invention of FIG. 1, a person would be required to exert less than 88 newtons of force on the metal bar 20 (If its length is greater than or equal to 41 centimeters) to move a 1362 kg mass automobile with inflated tires that has become immobile with its rear wheels in a ice, snow or mud rut. The principle of operation of this invention is based on the operation of said ratchet mechanism 36 driven by said metal bar 20 such that a small force applied on said metal bar 20 results in the application of a large force to the bumper of an automobile. The force on the automobile bumper has both horizontal and vertical components. The horizontal force provides most of the pushing force while the vertical component provides a lifting force on the automobile.

The embodiments of the invention in which an exclusive property at privilege is claimed are defined as follows:

1. A device for freeing automobiles from ice, snow or mud ruts, the device comprising:

a rubber cradle;

a metal cradle connected to the rubber cradle;

a curved hollow rectangular metal sleeve connected with nonslippage contact to the metal cradle as by a smooth steel pivot pin;

a ratchet mechanism connected to the curved hollow rectangular metal sleeve;

a curved solid metal rack post with identical radius of curvature as said hollow rectangular metal sleeve designed to mate with the mechanism;

a metal rectangular base connected to the curved rack post by a smooth steel pivot pin;

a set of metal studs mounted on the metal rectangular base to prevent slippage;

a telescoping metal strut connected to both said metal rectangular base and to said hollow rectangular metal sleeve by a smooth steel pins;

a spring loaded mechanism mounted on said telescoping metal strut;

a hand operated lever with two positions to engage or disengage the spring loaded mechanism.

* * * * *